US006241359B1

(12) United States Patent
Lin

(10) Patent No.: US 6,241,359 B1
(45) Date of Patent: Jun. 5, 2001

(54) FLUID FILLED LIGHT APPARATUS

(76) Inventor: Yung Chang Lin, No. 1, Lane 37, Hsin-i Road, Yu-li Chen, Hualien Hsien (TW)

( * ) Notice: Subject to any disclaimer, the term of this patent is extended or adjusted under 35 U.S.C. 154(b) by 0 days.

(21) Appl. No.: 09/291,410

(22) Filed: Apr. 13, 1999

(30) Foreign Application Priority Data

Apr. 14, 1998 (TW) ..... 87205621

(51) Int. Cl.[7] ..... F21V 33/00; A63H 33/26

(52) U.S. Cl. ..... 362/96; 362/101; 362/318; 362/806; 40/406; 40/441; 446/136; 446/267; 446/485

(58) Field of Search ..... 362/96, 101, 186, 362/318, 253, 806, 811; 40/406, 407, 409, 426, 439–441; 446/136, 267, 485

(56) References Cited

U.S. PATENT DOCUMENTS 3,593,444 * 7/1971 Akrongold et al. ..... 40/426
4,974,127 * 11/1990 Foley ..... 362/96
5,189,821 * 3/1993 Lee ..... 40/406
5,272,604 * 12/1993 Lin ..... 362/96
5,678,918 * 10/1997 Lin ..... 362/96

* cited by examiner

*Primary Examiner*—Alan Cariaso
(74) *Attorney, Agent, or Firm*—Mintz, Levin, Cohn, Ferris, Glovsky and Popeo, P.C.

(57) ABSTRACT

A fluid-filled light apparatus comprises a two-tube transparent container which provides light and produces distinct visual effects. The two-tube transparent container comprises an inner transparent tube suspended within an outer transparent tube. First terminal ends of each of the transparent tubes is sealed by a transparent tube cap which suspends the inner transparent tube within the outer transparent tube. A second terminal end of the outer transparent tube attaches the transparent tubes as one assembly to a base member. Each transparent tube holds liquid and decorative objects. The base member includes a motor, a power supply and an illuminating unit. Through magnetic coupling, the motor drives a magnet attached to a shaft of the motor which rotates and causes magnetic rotors positioned at the second terminal end of each of the transparent tubes to simultaneously rotate, causing liquids to spin and suspend decorative objects to produce a first visual effect in the outer inner transparent tube and a second visual effect in the inner transparent tube. The illuminating unit provides light through the transparent second terminal ends of each of the transparent tubes which enhances the visual effects produced.

21 Claims, 3 Drawing Sheets

FLUID FILLED LIGHT APPARATUS

FIELD OF THE INVENTION

The present invention relates to a fluid-filled light apparatus which provides light and simultaneously produces separate and distinct visual effects with a two-tube transparent container. The two-tube transparent container includes an outer transparent tube which contains liquid and colored decorative objects and an inner transparent tube which contains liquid and pearl-like particles. Separate and distinct visual effects are produced when decorative objects and pearl-like particles are simultaneously suspended by the rotational flow or spin of the liquid in which they are contained. Magnetic rotors disposed in each transparent tube simultaneously rotate and spin the liquids. Magnetic rotors are operated by a motor housed in a base member which mounts the two-tube transparent container as one assembly. The visual effects are enhanced by light provided from an illuminating unit housed in the base member.

BACKGROUND OF THE INVENTION

FIG. 1 shows a prior art fluid device which includes a centrifugal propeller mounted in a transparent container at an off-center position at bottom of the transparent container. A disc-like partition is mounted above the centrifugal propeller with a suction inlet disposed on the partition at a position corresponding to the centrifugal propeller. A plurality of discharge openings are provided at the periphery of the partition. Two different liquids are contained in the transparent container, each with a different specific gravity. A tornado-like whirlpool is produced when the centrifugal propeller rotates and draws down the liquid of lower specific gravity. The whirlpool can be produced in different sizes by the adjustment of the rotational speed of the centrifugal propeller.

Other than the size of the whirlpool, the prior art device cannot significantly alter nor vary the visual effect produced. The prior art device cannot, for instance, produce whirlpools of different shapes or forms. The prior art device produces only one visual scene and cannot simultaneously produce more than one visual effect.

In addition, the prior art device shown in FIG. 1 is constructed with the centrifugal propeller positioned in the transparent container whereby the centrifugal propeller and the liquids commingle. Such an arrangement of the centrifugal propeller produces a potential for damage to the centrifugal propeller by the liquids thereby reducing the life of the propellant means of the prior art device.

SUMMARY OF THE INVENTION

Embodiments of the present invention provide a fluid-filled light apparatus for providing light and pleasant visual effects comprising a two-tube transparent container which simultaneously produces separate and distinct visual effects by suspending decorative objects and pearl-like particles in a rotational flow of liquid in each of two transparent tubes. The present invention includes an outer cylindrical transparent tube which contains liquid and colored decorative objects, an inner cylindrical transparent tube which contains liquid and pearl-like particles, magnetic rotors disposed in each of the transparent tubes with a plurality of stirrer arms, a transparent tube cap and ring which seal-off a first terminal end of each of the transparent tubes and suspends the inner transparent tube within the outer transparent tube, and a base member which mounts the outer and inner transparent tubes as one assembly. The base member houses a motor, a power supply and an illuminating unit. The magnetic rotors disposed in each of the transparent tubes are in alignment and parallel to one another and a magnet attached to a shaft of the motor. During operation of the invention, the magnet attached to the motor shaft rotates and through magnetic coupling, created by a magnetic field produced by the motor magnet, causes the magnets of the rotors to simultaneously rotate and consequently spin the liquids of the transparent tubes. The construction and arrangement of the motor, the shaft and the magnet within the base member separates and seals-off these features from the liquids of the transparent tubes thereby eliminating any potential for damage to these features by the liquids.

The inner cylindrical transparent tube is necessarily of a smaller diameter and may be of a shorter length than the outer cylindrical transparent tube and is supported within the outer transparent tube by a transparent tube cap. The transparent tube cap is of the same diameter as the outer transparent tube and includes a ring to seal openings of each of the transparent tubes at a first terminal end and to centrally suspend the inner transparent tube within the outer transparent tube. In each of the outer and inner transparent tubes, a magnetic rotor is disposed at a second terminal end opposite the transparent tube cap which includes a rotor with a plurality of stirrers disposed on a side periphery of the rotor and a magnet mounted within the rotor. The magnet of the rotor in the outer transparent tube is positioned below and parallel the magnet of the rotor in the inner transparent tube. The outer and inner transparent tubes are mounted as one assembly to a base member by attachment of the second terminal end of the outer transparent tube to the base member. The bottom surfaces of the second terminal ends of the outer and the inner transparent tubes are transparent.

The base member includes a motor, a power supply and an illuminating unit. The motor is an electrical motor with a shaft on which is attached a magnet. The motor shaft and magnet are positioned below and parallel the magnets of the rotors of the outer and inner transparent tubes. The motor, the motor shaft and the magnet housed in the base member are separated and sealed-off from the liquid held in the outer transparent tube which prevents commingling of the liquid with the motor, the shaft and the magnet thereby eliminating any potential damage by the liquid to such features.

The power supply may be an electrical transformer, as in the case of A.C. power, or a battery bay equipped with batteries disposed within the base member, or, alternatively, external to the base member. The power supply furnishes electricity to both the electrical motor and the illuminating unit. The illuminating unit includes a reflector surface, such as a hemispherical reflector, and a light bulb which is connected to the power supply. The hemispherical reflector reflects light emitted from the light bulb upward toward the transparent bottom surfaces of the outer and inner transparent tubes. The transparency of the bottom surfaces permits light to be reflected into the outer and inner transparent tubes.

During operation, the motor drives the shaft and consequently rotates the magnet attached thereon which causes the magnets of the rotor in each of the outer and inner transparent tubes to simultaneously rotate. Rotation of the rotors is produced by magnetic coupling, whereby the magnet attached to the shaft of the motor and parallel to the magnets of the rotors rotates and produces a magnetic field which causes the magnets mounted within the rotors to simultaneously rotate. As the rotors rotate, the stirrer arms turn and spin the liquids in the outer and inner transparent tubes, suspending the decorative objects and pearl-like particles to create a first visual effect within the outer transparent tube and a second visual effect within the inner transparent tube. The light reflected by the hemispherical reflector through the transparent bottom surfaces into the inner and outer transparent tubes enhances the visual effects produced.

BRIEF DESCRIPTION OF THE DRAWINGS

The accompanying drawings, which are incorporated in and constitute a part of this specification, illustrate a preferred embodiment of the invention and, together with a general description of the invention given above, and the detailed description of the embodiment given below, serve to explain the principle of the invention, in which.

DETAILED DESCRIPTION OF THE INVENTION

Figure 1:
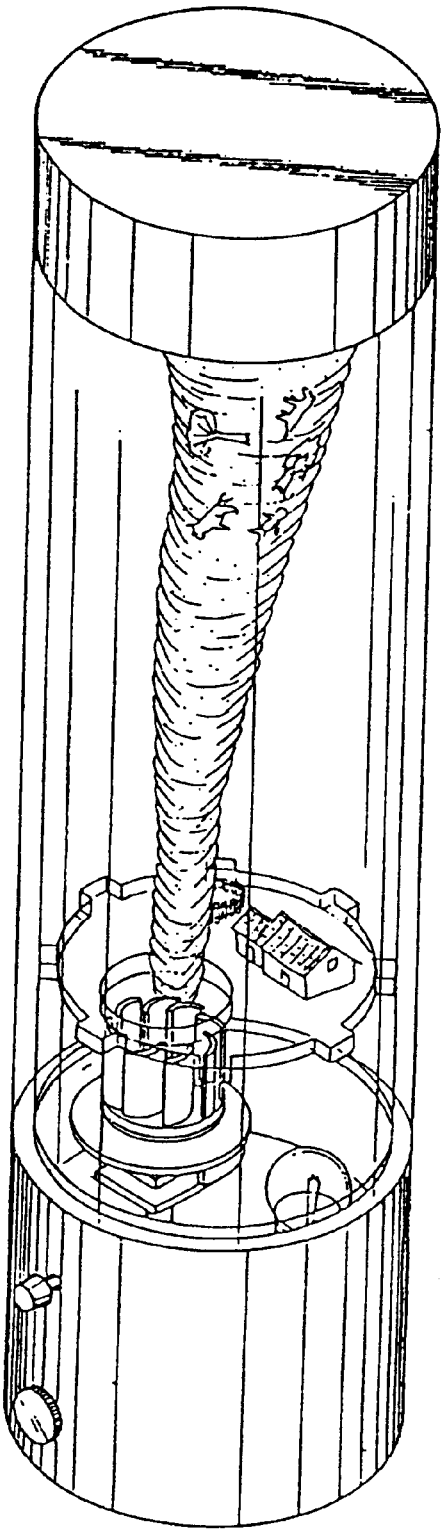
FIG. 1 is a view of the prior art fluid device.
Figure 2:
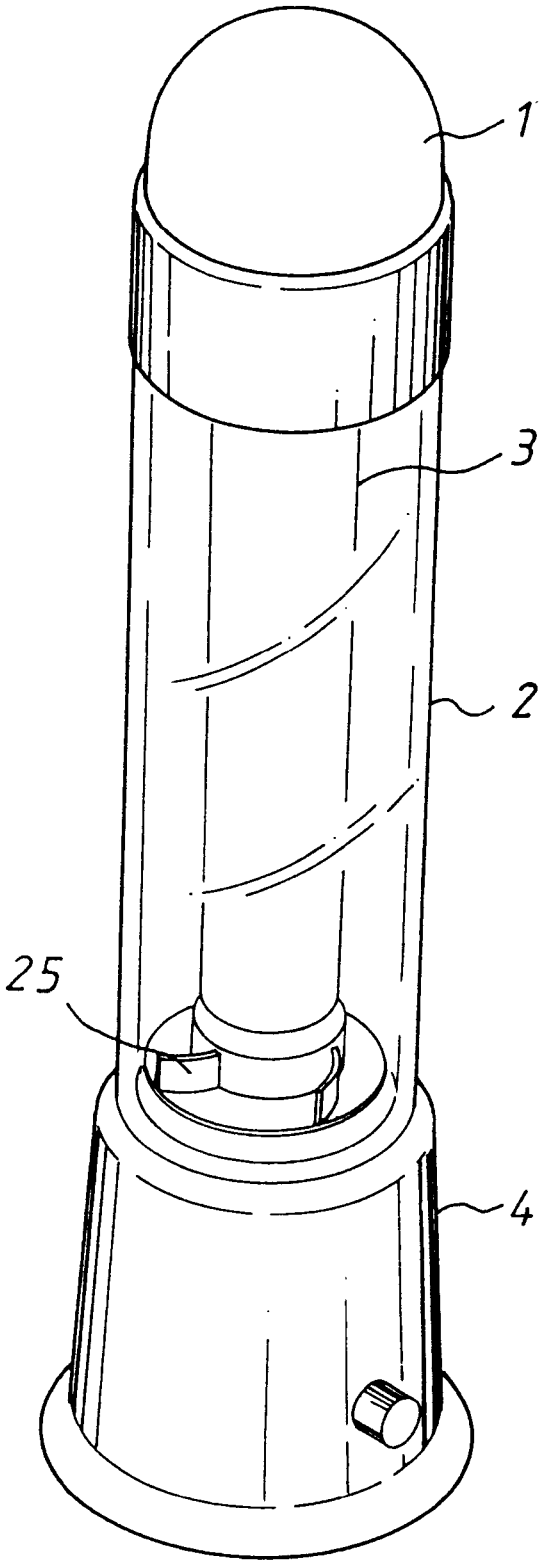
FIG. 2 is perspective of an embodiment of the present invention.
Figure 3:
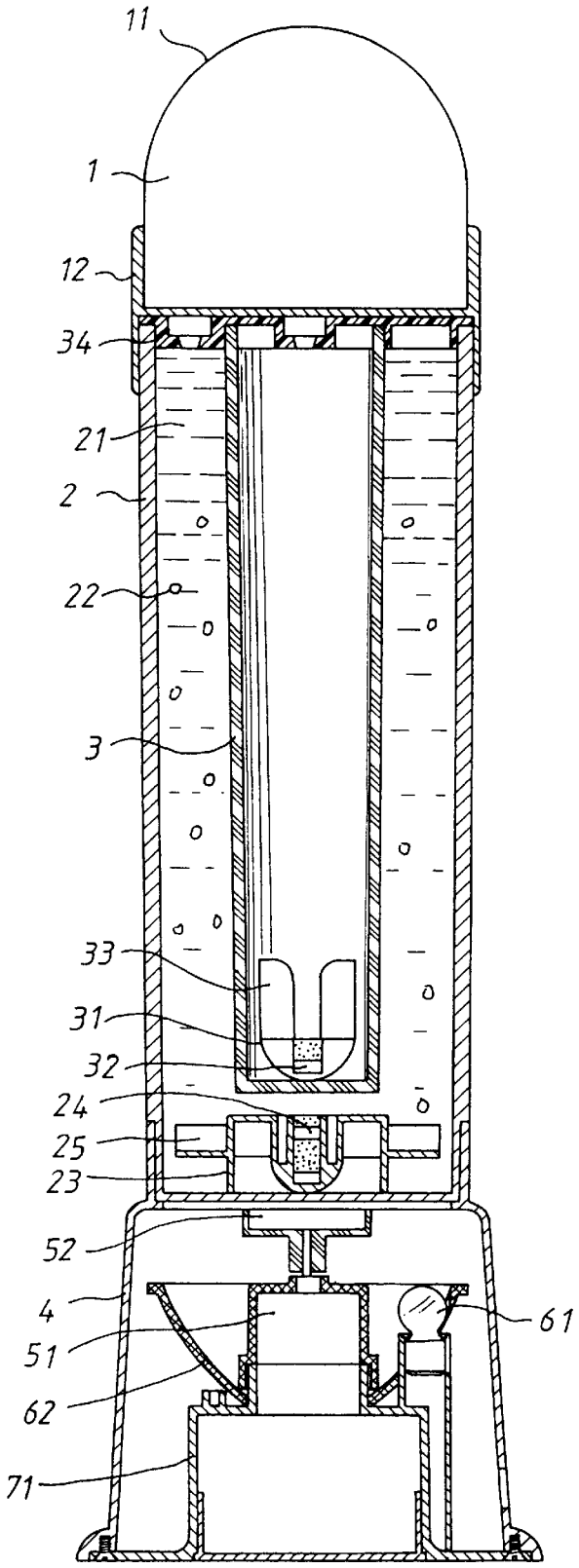
FIG. 3 is a cross-sectional view of an embodiment of the present invention.

Illustrative embodiments of the present invention described below are directed to a fluid-filled light apparatus which simultaneously produces separate and distinct visual effects and provides light. The fluid-filled light apparatus includes a two-tube transparent container which includes an inner transparent tube positioned within an outer transparent tube with each transparent tube containing liquid and decorative objects or pearl-like particles. Magnetic rotors are positioned at bottom of each of the transparent tubes which include a rotor, a plurality of stirrers arms and a magnet mounted within the rotor. The two-tube container is sealed at a first terminal end of each of the transparent tubes by a transparent tube cap and ring. The transparent tube cap and ring also suspend the inner transparent tube within the outer transparent tube. The two-tube container is mounted as one assembly to a base member by attaching a second terminal end of the outer transparent tube to the base member. The base member includes a motor with a shaft on which is attached a magnet, a power supply and an illuminating device Embodiments of the present invention will now be described below with reference to FIGS. 2 and 3. FIG. 2 shows an embodiment of the invention which includes an outer cylindrical transparent tube 2 and an inner cylindrical transparent tube 3 positioned within the outer transparent tube 2. The inner transparent tube 3 is necessarily of a smaller diameter and may be of a shorter length than the outer transparent tube 2, as shown. FIG. 3 shows a top portion of the fluid light apparatus 11 which is constructed and arranged as a transparent hemispherical tube cap 1 of the same diameter as the outer transparent tube 2. The transparent tube cap 1 includes a ring 12 which seals the openings of each of the outer and inner transparent tubes 2 and 3 at a first terminal end, and suspends the inner transparent tube 3 within the outer transparent tube 2. The outer transparent tube 2 is mounted at a second terminal end to a base member 4 thereby attaching the outer and inner transparent tubes 2 and 3 to the base member as one assembly. The outer transparent tube 2 includes a first magnetic rotor positioned at the second terminal end and comprises a first rotor 23 with a plurality of stirrer arms 25 disposed on a side periphery of the first rotor 23 and a first magnet 24 mounted within the first rotor 23. Similarly, the inner transparent tube 3 includes a second magnetic rotor, similar to the first magnetic rotor of the outer transparent tube 2, positioned at a second terminal end and comprises a second rotor 31 with a plurality of stirrer arms 33 disposed on a side periphery of the second rotor 31 and a second magnet 32 mounted within the second rotor 31. The first magnet 24 of the first rotor 23 is positioned below and parallel the second magnet 32 of the second rotor 31. The bottom surfaces of the second terminal ends of each of the transparent tubes 2 and 3 are transparent.

The outer transparent tube 2 holds liquid 21, which may be colorless, and decorative objects 22, which may be colored. The inner transparent tube 3 holds liquid, which may be colored, and pearl-like particles, which may be constructed of a pearlescent material. Although the embodiments shown in FIGS. 2 and 3 include decorative objects and colorless liquid in the outer transparent tube and pearl-like particles and colored liquid in the inner transparent tube, the objects and particles contained in the outer and inner transparent tubes are not limited in shape and color and may be constructed of a variety of materials in a number of shapes and colors, while the liquids contained in the outer and inner transparent tubes may be of any color.

The base member 4 includes a motor 51, a power supply 71 and an illuminating unit. The motor is an electrical motor 51 with a shaft connected at the top portion of the motor 51 on which a third magnet 52 is attached. The third magnet 52 is disposed below and parallel the first and second magnets 24 and 32 of the first and second rotors 23 and 31. As housed in the base member 4, the electrical motor 51, the shaft and the third magnet 52 are separated and sealed off from the liquid 21 held in the outer transparent tube 2. The liquid 21 and the electrical motor 51, the shaft and the third magnet 52 do not commingle thereby eliminating any potential damage to such features by the liquid 21. The power supply 71 may be an electrical transformer, as in the case of A.C. power, or a battery bay equipped with batteries for providing electricity to both the electrical motor 51 and the illuminating unit. The electrical transformer or battery bay may be positioned within the base member 4 below the electrical motor 51, as shown in FIG. 3, or may be located external to the base member 4. The illuminating unit includes a reflector surface 62, such as a hemispherical reflector, and a light bulb 61 which is connected to the power supply 71. The reflector surface 61 may be positioned on the power supply 71, as shown in FIG. 3.

The two distinct visual effects are simultaneously produced in the fluid-filled light apparatus by simultaneous rotational flow or spin of the liquids in the inner and the outer transparent tubes. Simultaneous rotational flow of the liquids is achieved by magnetic coupling of the first and second magnets 24 and 32 to the third magnet 52 mounted on the shaft of the electrical motor 52. The first and the second magnets 24 and 32 are in alignment with the third magnet 52 and positioned above and parallel the third magnet 52. When in operation, the electrical motor 51 drives the shaft and causes the third magnet 52 to rotate. The third magnet 52 produces a magnetic field while rotating and causes the first and the second magnets 24 and 32 to simultaneously rotate. As the first and the second magnets 24 and 32 rotate, the first and the second rotors 23 and 31 rotate. The rotation of the first rotor 23 turns the stirrer arms 25 which rotates or spins the liquid 21 in the outer transparent tube, while concurrently the rotation of the second rotor 33 turns the stirrer arms 33 which rotates or spins the liquid of the inner transparent tube. The rotational flow or spin of the liquid 21 in the outer transparent tube 2 suspends the decorative objects 22 in the liquid 21 to produce a first visual effect, while the rotational flow or spin of the liquid in the inner transparent tube 3 suspends the pearl-like particles to produce a second visual effect. During rotation of the liquids, light is emitted from the light bulb and reflected upward by means of the hemispherical reflector through the transparent bottom surfaces of and into the inner and the outer transparent tubes which provides light and enhances the dual visual effects produced.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A fluid-filled light apparatus to provide light and to produce a plurality of visual effects, comprising:

a first outer transparent tube with first and second terminal ends of a first diameter to hold liquid and first decorative objects therein;

a second inner transparent tube with first and second terminal ends of a diameter smaller than the first diameter positioned within the outer transparent tube to hold liquid and second decorative objects therein, the second terminal end of the first outer transparent tube extending beyond the second terminal end of the second inner transparent tube;

a transparent tube cap of the same diameter as the outer transparent tube which seals the first terminal end of each of the outer and inner transparent tubes; the second terminal end of each of the outer and inner transparent tubes being transparent;

a first magnetic rotor positioned at the second terminal end of the first outer transparent tube, the first magnetic rotor having a first rotor with a plurality of stirrer arms disposed therein and a first magnet mounted within the first rotor;

a second magnetic rotor positioned at the second terminal end of the second inner transparent tube above the first magnetic rotor, the second magnetic rotor having a second rotor with a plurality of stirrer arms disposed therein and a second magnet mounted within the second rotor; and a base member connected to the second terminal end of the outer transparent tube, the base member including a mechanism to cause movement of the first and second magnetic rotors and an illuminating unit to provide light.

2. The fluid-filled light apparatus of claim 1, wherein the mechanism for causing movement of the first and second magnetic rotors comprises an electrical motor with a shaft on which a third magnet is attached.

3. The fluid-filled light apparatus of claim 2, wherein the third magnet is below and parallel the first magnet of the first magnetic rotor and the second magnet of the second magnetic rotor.

4. The fluid-filled light apparatus of claim 1, wherein the first magnet of the first magnetic rotor is below and parallel the second magnet of the second magnetic rotor.

5. The fluid-filled light apparatus of claim 1, wherein the plurality of stirrer arms of the first magnetic rotor is disposed on a side periphery of the first rotor.

6. The fluid-filled light apparatus of claim 1, wherein the plurality of stirrer arms of the second magnetic rotor is disposed on a side periphery of the second rotor.

7. The fluid-filled light apparatus of claim 1, wherein the transparent tube cap comprises a ring attached thereto which seals the first terminal end of each of the outer and inner transparent tubes and suspends the inner transparent tube within the outer transparent tube.

8. The fluid-filled light apparatus of claim 1, wherein the second terminal end of each of the outer and inner transparent tubes is transparent.

9. The fluid-filled light apparatus of claim 2, wherein the electrical motor further comprises a power supply to provide electricity to the electrical motor.

10. The fluid-filled light apparatus of claim 9, wherein the power supply is an electrical transformer.

11. The fluid-filled light apparatus of claim 9, wherein the power supply is a battery bay equipped with batteries.

12. The fluid-filled light apparatus of claim 2, wherein the electrical motor further comprises a power supply located external to the base member and a means to connect the power supply to the electrical motor to provide electricity to the electrical motor.

13. The fluid-filled light apparatus of claim 1, wherein the illuminating unit comprises a reflector surface and a light bulb connected to a power supply.

14. The fluid-filled light apparatus of claim 13, wherein the reflector surface is a hemispherical reflector.

15. The fluid apparatus of claim 1, wherein the first decorative objects held in the outer transparent tube are of at least one color.

16. The fluid-filled light apparatus of claim 1, wherein the first decorative objects comprise at least one shape.

17. The fluid-filled light apparatus of claim 1, wherein the liquid held in the outer transparent tube is colorless.

18. The fluid-filled light apparatus of claim 1, wherein the second decorative objects held in the inner transparent tube are of at least one color.

19. The fluid-filled light apparatus of claim 1, wherein the second decorative objects held in the inner transparent tube are of at least one shape.

20. The fluid-filled light apparatus of claim 1, wherein the second decorative objects held in the inner transparent tube are constructed of pearlescent material.

21. The fluid-filled light apparatus of claim 1, wherein the liquid held in the inner transparent tube is at least one color.

* * * * *